United States Patent [19]

Fung et al.

[11] 4,124,492

[45] Nov. 7, 1978

[54] PROCESS FOR THE RECLAMATION OF WASTE HYDROCARBON OILS

[75] Inventors: David T. Fung, Longueuil; J. G. Jacques Laberge, McMasterville; Frederick S. Przystal, St. Bruno, all of Canada

[73] Assignees: Canadian Industries Limited; Tricil Limited, both of Montreal, Canada

[21] Appl. No.: 829,637

[22] Filed: Sep. 1, 1977

[30] Foreign Application Priority Data

May 19, 1977 [CA] Canada ..... 278793

[51] Int. Cl.[2] ..... C10G 37/00; C10M 11/00

[52] U.S. Cl. ..... 208/180; 208/182

[58] Field of Search ..... 208/180, 182

[56] References Cited

U.S. PATENT DOCUMENTS

| | | | |
|---|---|---|---|
| 1,766,768 | 6/1930 | Werkenthin | 208/180 |
| 3,639,229 | 2/1972 | Brownawell et al. | 208/181 |
| 3,819,508 | 6/1974 | Fainman et al. | 208/180 |
| 4,073,719 | 2/1978 | Whisman et al. | 208/180 |
| 4,073,720 | 2/1978 | Whisman et al. | 208/180 |

*Primary Examiner*—Herbert Levine

*Attorney, Agent, or Firm*—Donald G. Ballantyne

[57] ABSTRACT

Disclosed is a process for rejuvenating and reclaiming useful hydrocarbon oils from contaminated waste oils. The process comprises dehydrating the waste oil and thereafter dissolving the dehydrated oil in a selected amount of isopropanol or N-propanol at a temperature of from 45° C. to 80° C. The undissolved waste matter is separated and the residual oil/solvent fraction is distilled to recover the decontaminated oil and the solvent. The recovered oil can be further clarified by treatment with a bleaching clay or activated carbon at elevated temperatures. The process is more efficient and economic than those known heretofore resulting in high yields of reclaimed oil and more environmentally acceptable waste products.

5 Claims, No Drawings

PROCESS FOR THE RECLAMATION OF WASTE HYDROCARBON OILS

This invention relates to a process for the reclamation and reconditioning of waste hydrocarbon lubricating oils. In particular, the invention provides a process which is simpler and more economic to operate than those presently in use or described in the prior art.

Large and increasing volumes of used lubrication oil, particularly crankcase oils from internal combustion engines are produced each year. These waste oils are contaminated with oxidation and degradation products, water, fine particulate metal and carbon and oil additive products. This contamination renders the oils unsuitable for continued use. Waste oils have for the most part been disposed of by incineration, in landfill or used in road oiling for dust control because the costs of reclaiming and re-refining have been excessive. However, because of the rising cost of hydrocarbon fuels and lubricants and the ever-increasing demand coupled with a depletion of resources, the need for an efficient, low cost waste oil reclamation process has become vital.

Several waste oil reclamation processes are known from the prior art. In the U.S. Pat. No. 3,639,229, for example, a process is described where a mixture of an aliphatic monohydric alcohol of from 4 to 5 carbon atoms (e.g. n-butanol) and a light hydrocarbon (e.g. pentane) is added to waste oil. The mixture settles into three distinct layers. The upper oily layer is recovered, treated with sulphuric acid and thereafter refined by conventional means. In U.S. Pat. No. 3,919,076 a process is described which involves removing water from the waste oil, adding a saturated hydrocarbon solvent (e.g. propane), settling the mixture to recover the oil/-solvent mix, removing the solvent, vacuum distilling the residual oil to collect selected fractions, hydrogenating the fractions over a catalyst, stripping hydrogenated oil to remove light ends and filtering the remaining product. In U.S. Pat. No. 3,819,508 a process is described wherein the waste oil is mixed with hydrocarbon solvent/diluent and thereafter mixed with an alcohol-water mixture containing a base. The diluted oil phase and alcohol-water phase are separated to provide a pure organic residue. The useful heavy oil may then be recovered by distillation. Another well known process currently in use is the acid/clay process which involves filtering the waste oil to remove solids, treating the separated oil with acid, settling and removing the acid sludge, neutralizing any residual acid in the oil with an alkali, mixing the oil with a finely divided clay and filtering out the final, recovered oil product.

While all of the aforementioned processes are meritorious, none is completely satisfactory from an economic or anti-pollution point of view. Either large volumes of environmentally unacceptable by-products are generated or a large number of process steps are required resulting in economic disadvantages.

In accordance with the present invention an improved process is provided for the reclamation of waste hydrocarbon oils, which improved process consists of the following sequential steps:

1. Heating waste hydrocarbon oil at from 150° to 210° C. and atmospheric pressure to reduce the water content of the oil to less than 3% by weight and to reduce the ethylene glycol content of the oil to less than 15% by weight, and to remove light ends.

2. Mixing one part by weight of the dehydrated/deglycolated waste oil with a solvent selected from at least 2.2 parts by weight of isopropanol (IPA) or at least 1.5 parts by weight of N-propanol (NPA) at a temperature of from 45° C. to 80° C.

3. Filtering the heated oil/propanol solution to remove suspended waste matter; and 4. Distilling the clarified oil/propanol mixture to separate and recover the residual oil and propanol.

The reclaimed oil may be further clarified or bleached by mixing it with 5% or more of finely divided bleaching clay or activated carbon at elevated temperatures for about 5 minutes and thereafter the oil/clay or oil/carbon mixture may be filtered to recover the clarified oil. Alternatively, the reclaimed oil may be subjected to vacuum distillation and hydrotreating to produce a recovered clear oil distillate.

The process of the invention provides a number of significant advantages over known waste oil reclamation processes. The waste oil does not require dilution with light hydrocarbon nor treatment with acid or alkali prior to solvent extraction. The use of substantially anhydrous propanol results in only two layers or phases thus simplifying the separation step. Solvent/oil temperatures of 45° C.–80° C. which are essential to the process, result in high solubility of the useful oil fraction in the chosen solvent. At lower temperatures some oil and accompanying dense tarry material comprising the unwanted waste fraction remains emulsified causing difficult separation. At 45° C. or higher, complete dissolution of the useful oil in the propanol is very rapid, generally within about 2–120 seconds, while the undesirable tarry waste material remains undissolved and hence may be easily and quickly removed. Solvent treatment temperature in excess of 80° C. tend to result in a reduction in product quality. The presence of more than about 0.8% by volume of water or 4% by weight of ethylene glycol in the oil/solvent mixture tends also to significantly reduce the effectiveness of the solvent extraction. When both water and ethylene glycol are present, the water content of the oil is preferably less than 0.1% by weight and the glycol content preferably less than 0.1% by weight. The optional but desirable clay or carbon treatment clarification step at elevated temperature is very rapid and the spent contaminated clay may be easily disposed of in landfills or by incineration.

Compared with prior art processes, the process of the present invention employs fewer process steps and the recovered end-product oil may be used for lubrication purposes without further refining. Because of the very rapid dissolution of oil in the solvent, the process lends itself to continuous plant operation with an elapsed process time of only about 30 minutes. This compares favourably with the presently widely used acid treatment process which may require an in-process time of from 36 to 60 hours. In addition, the recovered contaminants or sludge from the solvent extraction step may contain up to as much as 9% of recoverable lead and other trace metals. Thus this sludge in addition to its fuel value, has important commercial mineral value for use in secondary lead smelting operations.

It has been found that N-propanol (NPA) or 2-isopropanol (IPA) are the only effective extraction solvents for use in the process of the invention. Butyl alcohol, for example, is found to dissolve excessive amounts of the tarry waste material, which comprises most of the contaminants in the waste oil, even at ambient temperatures. Ethyl alcohol, for example, does not dissolve sufficient amounts of the useful oil fraction even when heated to boiling. An explanation of the particular utility of N-propanol and isopropanol may lie in the observation that micron-sized particles of the undesirable tarry waste material which are suspended in the waste oil are covered with a layer of heavy oil, which heavy oil is not soluble in propanol, thus permitting oil-coated globules of the tarry material to precipitate out of solution. When more powerful solvents such as butanol are employed, the heavy oil layer surrounding the tarry particles is dissolved and the residue micron-sized tarry particles remain emulsified and suspended in the solution. Special measures are then required to cause precipitation of these suspended, small tarry particles. The process of the present invention, because of the special utility of the propanol solvent, at temperatures of from 45° C. to 80° C., preferably 55° C. to 65° C., relies nearly entirely on physical separation of the agglomerated waste material, thus resulting in a simplified process.

The following examples demonstrate the efficacy of the process of the invention.

EXAMPLE 1

A quantity of waste car crankcase oil was heated in a laboratory vessel to 210° C. to remove water, ethylene glycol and light ends. (The characteristics of typical waste oils are shown in Table I, below). One part by weight of the resultant dehydrated, black, contaminated oil was stirred rapidly with three parts by weight of 2-propanol at 60° C. for 2 minutes. The resulting solution containing suspended globules of tarry material was filtered through diatomaceous earth under vacuum at 50°–60° C. The filtrate was subjected to vacuum distillation to distill off and recover the 2-propanol. The yield based on the mass of dehydrated oil treated was 95%. The resulting clear, brown-coloured oil was then mixed with 10% by weight of finely divided activated bleaching clay at 360° C. for 10 minutes and the oil then filtered through a glass fibre filter under vacuum. The color of the final product oil was 5.5 ASTM approved. A quantity of the unbleached recovered oil treated at 360° C. with 10% by weight of activated carbon instead of clay produced a color of 7.5 ASTM. Treatment with 10% by weight of another finely divided activated bentonite clay producing a color of 4.5 ASTM. The overall yield of the process was 75.5% based on the amount of dehydrated waste oil employed. Chemical analysis showed the recovered oil to be suitable as a base stock for reformulating automobile engine lubricants. With the addition of suitable additives it would be suitable as hydraulic oil, chain saw oil, 2 cycle engine oil and the like.

TABLE I

| Characteristics of Waste Oils | | | Used Auto Crankcase Oil | Used Diesel Lube Oil |
|---|---|---|---|---|
| Specific gravity | API | 60° F. | 26.35 | 24.7 |
| | g/cc | | 0.896 | 0.906 |
| Viscosity | sus | 100° F. | 329 | 351 |
| | sus | 210° F. | 59.2 | 65.7 |
| Viscosity index | | | 124 | 137 |
| Water content | % | | 0.325 | 10.3 |
| Ash content | % | | 2.23 | 0.96 |
| Lead | % | | 0.875 | 0.012 |
| Sulphur | % | | 0.455 | 0.37 |
| pH | | | 5.5 | — |
| Color | | | Black | Black |
| Specific heat | cal/g. C. 25 C. | 0.42 | — | |

EXAMPLE 2

A series of samples of used and dehydrated diesel lubricating oil were subjected to propanol solvent extractions as described in Example 1 under various conditions of solvent/oil ratio, mixing times and mixing temperatures. The results are tabulated below in Table II.

TABLE II

| Test No. | Solvent | Solvent/ Oil ratio (wt.) | Mixing temp. ° C. | Duration of Mixing (Min.) | Oil Clarified by Filtration *2 | Step *1 Yield % | Oil re-refined by Color (ASTM) | Clay Treatment Yield (%) *1 |
|---|---|---|---|---|---|---|---|---|
| 1 | NPA | 3:1 | 60 | 2 | Good | 88.0 | 4.0 | 70.6 |
| 2 | IPA | 2:1 | 60 | 0.5 | No good | — | — | — |
| 3 | IPA | 2:1 | 40 | 10 | No good | — | — | — |
| 4 | IPA | 5:1 | 60 | 0.5 | Good | — | — | — |
| 5 | IPA | 5:1 | 40 | 10 | Marginal | — | — | — |
| 6 | IPA | 3:1 | 60 | 0.5 | Good | — | — | — |
| 7 | IPA | 3:1 | 60 | 5 seconds | Good | 88.6 | — | — |
| 8 | IPA | 2.5:1 | 60 | 1.0 | Good | — | — | — |
| 9 | IPA | 3:1 | 45 | 1.0 | No good | — | — | — |
| 10 | IPA | 10:1 | 35 | 15 | Good | — | — | — |
| 11 | IPA | 10:1 | 24 | 30 | Good | 80.0 | — | — |
| 12 | IPA | 2.2:1 | 60 | 2 | Marginal | — | — | — |
| 13 | NPA | 2:1 | 60 | 0.5 | Good | 88.6 | 3.25 | 70 |
| 14 | NPA | 2:1 | 40 | 10 | No good | — | — | — |
| 15 | NPA | 5:1 | 60 | 0.5 | Good | — | — | — |
| 16 | NPA | 5:1 | 40 | 10 | Good | — | — | — |
| 17 | NPA | 1.5:1 | 60 | 1.0 | Marginally good | 91.0 | 5.0 | 72.3 |
| 18 | NPA | 4:1 | 24 | 15 | Marginal | 51.3 | — | — |
| 19 | NPA | 1.5:1 | 80 | 1.0 | No good | — | — | — |
| 20 | NPA | 1.75:1 | 40 | 0.5 | No good | — | — | — |
| 21 | NPA | 1.75:1 | 60 | 1.0 | Good | — | — | — |

NPA = N-propanol
IPA = Isopropanol
*1 Yield percentage based on mass of dehydrated oil treated
*2 Filtrate classification:
Good = All tarry material retained at the top layer of the Celite 503 filter bed
Marginal = Some penetration of the tarry material into the filter bed
No good = Filter bed penetrated by tarry material An examination of the data contained in Table II shows the interaction between solvent/oil ratios, mixing time and mixing temperature. IPA/oil ratios of 2:1 even at high temperature (Test 2) or at long mixing time (Test 3) yield unsatisfactory results, indicating that an IPA/oil ratio of at least about 2.2:1 was required.

Similarly, an NPA/oil ratio of at least about 1.5:1 is indicated as essential since lower ratios even at high temperatures (Test 19) failed to produce satisfactory results.

It will be obvious to those skilled in the art that certain modifications to the process of the invention are possible and may, under some conditions, be desirable. For example, the initial dehydrating step may be conducted under vacuum and hence at temperatures lower than 150° C. to 210° C. Similarly, the filtration operation of step 3 may be replaced with centrifuging or sedimentation thus eliminating the cleaning of filters. The solvent treated oil may also be further improved by vacuum distillation and/or hydrotreatment. These and other modifications of the disclosed process are deemed to be obvious alternatives or additions to the steps described.

The high yield process of the invention provides substantial improvements over the solvent extraction process known from the prior art. The present process employs only relatively small amounts of solvent with very short mixing times at elevated temperatures. The additional clarification treatment using high temperatures, requires only short residence time and the waste tarry sludge and spent clay or other clarification material are more environmentally acceptable than are the waste products of prior processes.

What we claim is:

1. A process for reclaiming waste hydrocarbon oils comprising the sequential steps of:

(a) heating waste hydrocarbon oil at from 150° C. to 210° C. and atmospheric pressure, or at the sub-atmospheric pressure/temperature equivalent thereof, to reduce the water content of the oil to less than 3% by weight and to reduce the ethylene glycol content of the oil to less than 15% by weight;

(b) mixing one part by weight of the dehydrated/deglycolated waste oil with a solvent selected from at least 2.2 parts by weight of isopropanol or at least 1.5 parts by weight of N-propanol or proportioned mixture of these at a temperature of from 45° C. to 80° C.;

(c) separating the undissolved, suspended waste matter from the heated oil/propanol solution, and (d) distilling the residual oil/propanol solution to separate and recover the oil fraction and the solvent fraction.

2. A process as claimed in claim 1 comprising the additional step of mixing the recovered oil fraction with from 5% to 25% by weight of a finely divided bleaching agent selected from bleaching clay and activated carbon at a temperature of at least 300° C. for about 5 minutes to bleach the oil and thereafter filtering the oil/bleaching agent mixture to recover the clear oil.

3. A process as claimed in claim 1 wherein the water content of the waste oil is reduced to less than 0.1% by weight of the oil.

4. A process as claimed in claim 1 wherein the ethylene glycol content of the waste oil is reduced to less than 0.1% by weight of the oil.

5. A process as claimed in claim 1 wherein the waste hydrocarbon oil comprises used automobile crankcase oil and used diesel lubricating oil.

* * * * *